US011247488B2

(12) United States Patent
Mei et al.

(10) Patent No.: US 11,247,488 B2
(45) Date of Patent: Feb. 15, 2022

(54) PRINTER HEAD FOR STRAND ELEMENT PRINTING

(71) Applicant: Palo Alto Research Center Incorporated, Palo Alto, CA (US)

(72) Inventors: Ping Mei, San Jose, CA (US); Warren Jackson, San Francisco, CA (US); Steven E. Ready, Langley, WA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 16/296,377

(22) Filed: Mar. 8, 2019

(65) Prior Publication Data

US 2020/0282746 A1 Sep. 10, 2020

(51) Int. Cl.

| | |
|---|---|
| ***B41J 3/407*** | (2006.01) |
| ***B41J 2/14*** | (2006.01) |
| ***B41J 2/045*** | (2006.01) |
| ***D06P 5/30*** | (2006.01) |
| ***D05C 11/24*** | (2006.01) |

(52) U.S. Cl.

CPC ..... *B41J 3/4078* (2013.01); *B41J 2/045* (2013.01); *B41J 2/1404* (2013.01); *D05C 11/24* (2013.01); *D06P 5/30* (2013.01)

(58) Field of Classification Search

CPC ..... B41J 3/4073; B41M 5/0047; B41F 17/08; B41F 17/10

See application file for complete search history.

(56) References Cited

U.S. PATENT DOCUMENTS

| | | | | |
|---|---|---|---|---|
| 1,384,940 A | | 7/1921 | Denison | |
| 2,644,423 A | | 7/1953 | Bauer | |
| 3,227,077 A | | 1/1966 | Farrer et al. | |
| 3,600,730 A | | 8/1971 | Evans | |
| 3,762,867 A | | 10/1973 | Crawford | |
| 4,308,716 A | | 1/1982 | Bauer | |
| 4,465,005 A | | 8/1984 | Eguchi et al. | |
| 5,226,973 A | * | 7/1993 | Chapman | B08B 9/023 134/151 |

(Continued)

FOREIGN PATENT DOCUMENTS

| | | | |
|---|---|---|---|
| JP | 2014224899 A | | 12/2014 |
| WO | 2010076823 A1 | | 7/2010 |

(Continued)

OTHER PUBLICATIONS

Lee T. et al., "Nozzle-Free Liquid Microjetting via Homogeneous Bubble Nucleation", Physical Review Applied 3, 044007 (2015).

(Continued)

*Primary Examiner* — Lam S Nguyen

(74) *Attorney, Agent, or Firm* — Fox Rothschild LLP

(57) ABSTRACT

A system and method of printing on a strand element with a printer head. The printer head includes a conduit and a cavity formed within the conduit, wherein the cavity is configured to receive the strand element and pass the strand element from a first end of the cavity to a second end of the cavity. The printer head also includes a first set of fluid nozzles formed on the conduit and positioned on a perimeter of the cavity around a first target location within the cavity, wherein each of the fluid nozzles in the first set is positioned to aim at the first target location, and the first target location corresponds to a location of a first segment of the strand element when the strand element is positioned within the cavity.

18 Claims, 4 Drawing Sheets

(56) References Cited

U.S. PATENT DOCUMENTS

| | | | | |
|---|---|---|---|---|
| 5,853,859 | A | 12/1998 | Levy et al. | |
| 6,189,989 | B1 | 2/2001 | Hirabayashi et al. | |
| 6,276,779 | B1 | 8/2001 | Smith | |
| 6,690,908 | B1 | 2/2004 | Gayoso | |
| 7,302,308 | B2 | 11/2007 | Kato et al. | |
| 7,378,130 | B2 | 5/2008 | Coronado et al. | |
| 8,993,061 | B2 | 3/2015 | Jones et al. | |
| 9,162,503 | B2 * | 10/2015 | Monteiro | B41J 3/40733 |
| 10,525,734 | B1 | 1/2020 | Jackson et al. | |
| 2005/0195261 | A1 | 9/2005 | Stelter et al. | |
| 2007/0095218 | A1 * | 5/2007 | Strange | B41J 3/413 101/35 |
| 2011/0254896 | A1 | 10/2011 | Ferrarotti et al. | |
| 2013/0194338 | A1 * | 8/2013 | Hawkins | B41J 2/04505 347/15 |
| 2018/0171520 | A1 | 6/2018 | Eklind et al. | |

FOREIGN PATENT DOCUMENTS

| | | | |
|---|---|---|---|
| WO | 2016204686 | A1 | 12/2016 |
| WO | 2017200473 | A1 | 11/2017 |
| WO | 20170203524 | A1 | 11/2017 |

OTHER PUBLICATIONS

Jang D. et al., "Influence of Fluid Physical Properties on Ink-Jet Printability", Langmuir 2009, 25, pp. 2629-2635.

He B. et al., "The roles of wettability and surface tension in droplet formation during inkjet printing", Scientific Reports 7 (1), Feb. 2017.

Friend J. et al., "Microscale acoustofluidics: Microfluidics driven via acoustics and ultrasonics", Reviews of Modern Physics, vol. 83, Apr.-Jun. 2011.

Hadimioglu B. et al., "Acoustic Ink Printing", Ultrasonics Symposium, 1992, Proceedings, IEEE.

Ellson R. et al., "Transfer of Low Nanoliter Volumes between Microplates Using Focused Acoustics—Automation Considerations", JALA, Oct. 2003.

Roessler C.G. et al., "Acoustic Injectors for Drop-On-Demand Serial Femtosecond Crystallography", Structure 24, 631-640, Apr. 5, 2016.

* cited by examiner

PRINTER HEAD FOR STRAND ELEMENT PRINTING

BACKGROUND

Printers have long been used for a variety of applications, with the most typical printers being utilized for printing ink on sheets of two-dimensional paper. However, advancements in printing technology (and inkjet printing technology, in particular) have made printing on three-dimensional surfaces possible, including printing on cylindrical objects.

More recently, mechanisms have been developed for inkjet printing on individual strand elements such as, e.g., fabric threads. Unlike conventionally dyed threads, inkjet thread printing allows each thread to include multiple colors along its length. However, colorizing a thread by way of inkjet printing has several drawbacks. For example, as many threads consist of three-ply twisted fibers bundled together, the overall diameter of the thread can be quite large (e.g., 200 micrometers or more). However, the ink droplets emitted from an inkjet printer are typically low in volume (e.g., 10-15 picoliters), and thereby have droplet diameters much smaller than the diameter of the thread itself. Furthermore, the ink droplets are typically emitted from only one direction, meaning that volume of ink emitted during inkjet printing is often too low to fully coat and/or be fully absorbed into the thread.

Accordingly, there is a need for a system capable of printing on individual strand elements (e.g., threads) which addresses the issues described above.

SUMMARY

According to an aspect of the disclosure, an apparatus for printing on a strand element is disclosed. The apparatus may include a printer head. The printer head may include a conduit, and a cavity formed within the conduit. The cavity may be configured to receive the strand element and pass the strand element from a first end of the cavity to a second end of the cavity. The printer head may further include a first set of fluid nozzles formed on the conduit and positioned on a perimeter of the cavity around a first target location within the cavity. Each of the fluid nozzles in the first set may be positioned to aim at the first target location. The first target location may correspond to a location of a first segment of the strand element when the strand element is positioned within the cavity.

In accordance with another aspect of the disclosure, an apparatus for printing on a strand element is disclosed. The apparatus may include a printer head. The printer head may have a conduit and a cavity formed within the conduit. The cavity may be configured to receive the strand element and pass the strand element from a first end of the cavity to a second end of the cavity. The printer head may also include a plurality of nozzles formed on the conduit and positioned on a perimeter of the cavity. Each of the nozzles may be positioned to aim in the direction of a segment of the strand element passing through the cavity.

According to another aspect of the disclosure, a method for printing on a strand element is disclosed. The method may include providing a printer head, the printer head having a conduit, a cavity formed within the conduit, and a plurality of fluid nozzles formed on the conduit and positioned on a perimeter of the cavity around a target location within the cavity, wherein each of the fluid nozzles in is positioned to aim at the target location. The method may also include passing the strand element through the cavity of the printer head. Additionally, the method may include dispensing fluid from each of the fluid nozzles in the direction of the strand element within the cavity of the printer head.

DETAILED DESCRIPTION

Figure 1:
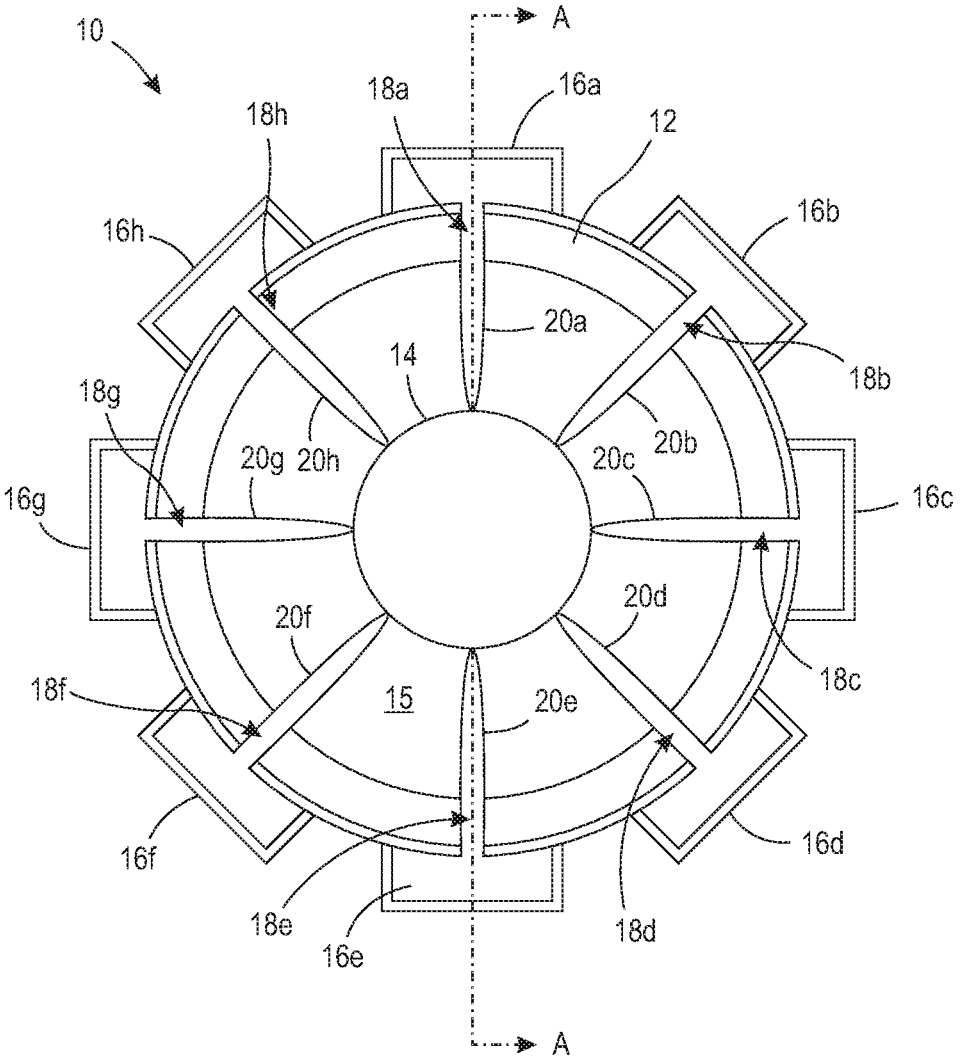
FIG. 1 illustrates an end cross-sectional view of a strand element printer head in accordance with an aspect of the disclosure.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The terms "electronic device", "computer", and "computing device" refer to a device or system that includes a processor and memory. Each device may have its own processor and/or memory, or the processor and/or memory may be shared with other devices as in a virtual machine or container arrangement. The memory will contain or receive programming instructions that, when executed by the processor, cause the electronic device to perform one or more operations according to the programming instructions. Examples of electronic devices include personal computers, servers, mainframes, virtual machines, containers, mobile electronic devices such as smartphones, Internet-connected wearables, tablet computers, laptop computers, and appliances and other devices that can communicate in an Internet-of-things arrangement. In a client-server arrangement, the client device and the server are electronic devices, in which the server contains instructions and/or data that the client device accesses via one or more communications links in one or more communications networks. In a virtual machine arrangement, a server may be an electronic device, and each virtual machine or container also may be considered an electronic device. In the discussion below, a client device, server device, virtual machine or container may be referred to simply as a "device" for brevity. Additional elements that may be included in electronic devices will be discussed below in the context of FIG. 5.

Figure 2:
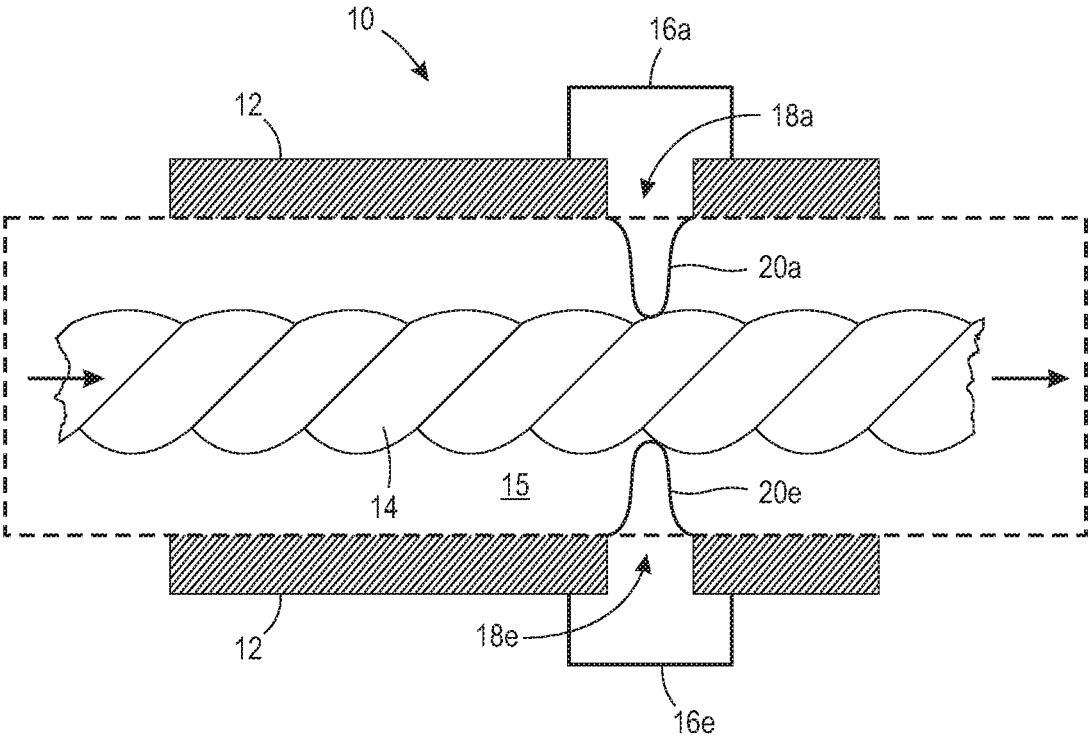
FIG. 2 illustrates a side cross-sectional view of the strand element printer head of FIG. 1 along line A-A.

Referring to FIGS. 1-2, a printer head 10 configured for printing directly on a single strand element 14 in accordance with an aspect of the disclosure is illustrated. For the purposes of the present disclosure, it is to be understood that the strand element 14 may include any twisted or non-twisted elongated material or element such as, e.g., a thread, yarn, filament, wire, optic fiber, microtube for fluid flow, rod, cable, rope, etc. In the configuration shown in FIGS. 1-2, printer head 10 includes a substantially cylindrical conduit 12, with the strand element 14 being able to pass longitudinally through the center of a cavity 15 formed in the conduit 12. While FIG. 1 illustrates conduit 12 as being cylindrical, it is to be understood that the cross-sectional shape of conduit 12 may be other, alternative shapes (e.g., square, rectangular, elliptical, etc.).

In some embodiments, such as that shown in FIGS. 1-2, strand element 14 is passed longitudinally through the conduit 12, with conduit 12 remaining stationary as strand element 14 passes therethrough. While not shown in FIGS. 1-2, it is to be understood that the strand element 14 may be directed through the conduit 12 by any appropriate means, such as, e.g., a pair of automated spools, etc. Additionally, the strand element 14 may move at any appropriate speed through conduit 12 (e.g., 0.5 m/s, 20 m/s, etc.), and the speed need not necessarily be constant. Alternatively, in another embodiment, strand element 14 may be held stationary, with conduit 12 controlled to move longitudinally along a predetermined length of strand element 14.

As shown in FIG. 1, a plurality of jet heads **16*a*-16*h* are disposed radially around an exterior surface of conduit 12. While not shown in FIGS. 1-2, each jet head 16*a*-16*h* may be fluidly coupled to one or more fluid reservoirs such that one or more fluids is capable of being supplied to the jet heads 16*a*-16*h*. In accordance with some aspects of the disclosure, the fluid(s) may be one or more colors of ink. However, it is to be understood that the fluid delivered by each jet head 16*a*-16*h* may be dependent upon the application and type of strand element 14 passing through cavity 15**. For example, the fluid may be one or more colorant inks, one or more insulating polymers, one or more protective coatings, etc.

Each jet head **16*a*-16*h* is positioned over and in fluid communication with a respective nozzle 18*a*-18*h* formed through the conduit 12, thereby enabling fluid to be delivered from each jet head 16*a*-16*h* through a corresponding nozzle 18*a*-18*h* to the strand element 14 within cavity 15, as will be described in further detail below. While eight jet heads 16*a*-16*h* and eight nozzles 18*a*-18*h* are radially disposed about conduit 12**, it is to be understood that more or fewer jet heads and/or nozzles may be utilized.

Referring still to FIGS. 1-2, each jet head **16*a*-16*h* is configured to synchronously fire fluid in the direction of strand element 14 such that the circumferential surface of strand element 14 receives fluid from multiple directions, which allows the fluid to better coat and/or absorb into the strand element 14 at a desired printing location. However, unlike previous inkjet thread printing processes, which fire small droplets of ink in the direction of the thread and/or fabric to be printed, printer head 10 may be configured to utilize jet heads 16*a*-16*h* to dispense fluid through nozzles 18*a*-18*h* in the form of a pressure-driven meniscus 20*a*-20*h***.

A meniscus of a liquid is generally defined as a curve in the upper surface of the liquid close to the surface of another object and is typically caused by surface tension. However, a meniscus may also be extended by the application of external pressure, such as, e.g., fluidic pressure, magnetic fields (in the case of magnetic fluids), and/or ultrasonic acoustic pressure to the liquid. In the case of the embodiment shown in FIGS. 1-2 of the present disclosure, the jet heads **16*a*-16*h* may be configured to apply pressure (e.g., fluidic pressure, ultrasonic acoustic pressure, magnetic fields, etc.) to the fluid such that a meniscus 20*a*-20*h* in the form of a column of fluid extends radially inward from a respective nozzle 18*a*-18*h* in the direction of a target location at or substantially near an outer surface of the strand element 14. Due to surface tension, the fluid in each meniscus 20*a*-20*h* does not disperse or otherwise form into small droplets, but is instead maintained in a column-like form. Thus, as the strand element 14 passes through the cavity 15, surfaces of the strand element 14 may contact each meniscus 20*a*-20*h*, thereby enabling the fluid from each meniscus 20*a*-20*h* to be wicked or otherwise drawn onto (and into) the strand element 14** from multiple directions.

As the column of fluid provided by each meniscus **20*a*-20*h* is far greater in volume than droplets of fluid provided during conventional inkjet printing, a greater amount of fluid may be supplied to the strand element 14 at one time, sufficiently allowing for the fluid to be soaked into (or coated onto) the strand element 14. For example, the combined fluid volume provided by the menisci 20*a*-20*h*** may amount to about a nanoliter, whereas a comparable volume of fluid provided during an inkjet printing process may amount to tens of picoliters, which is generally not sufficient to soak into a typical 200 μm cotton thread, particularly if the thread is moving through or past a printer head at any notable rate of speed.

In order for the strand element 14 to come into contact with each meniscus **20*a*-20*h* as the strand element 14 passes through cavity 15 such that the fluid is transferred onto the strand element 14, the distance between the outer surface of strand element 14 and the nozzles 18*a*-18*h* must be sufficiently small. For example, in one embodiment, the distance between the outer surface of strand element 14 and the nozzles 18*a*-18*h* is 500 μm or less, and is preferably 200 μm or less. This minimal distance may also allow the capillary force of the strand element 14 moving within the cavity 15 to draw the fluid from each meniscus 20*a*-20*h* onto the strand element 14**. However, it is to be understood that the distance between the strand element and nozzle(s) may be larger or smaller than that which is disclosed, and may depend upon the diameter of the strand element, the size of the nozzle(s), the pressure applied to form each meniscus, etc. Furthermore, the size of the nozzle(s) may be determined based on the resonant frequency needed to maintain the meniscus within the cavity of the printer head at a sufficient depth so as to allow for fluid transfer onto the strand element.

As noted above, one method of forming each meniscus **20*a*-20*h* may be the application of ultrasonic acoustic pressure to the fluid. In this method, also known as acoustic jetting, sound waves are generated and focused toward the surface of a fluid pool in order to emit a column of fluid in the form of a meniscus, with the size of the column of fluid produced being at least partially a function of different acoustic transducers with different center frequencies (e.g., 5 MHz, 10 MHz, 15 MHz, etc.). For example, using continuous acoustic radiation fields of about 3.5 $kW/cm^2$ focused on a 300 μm diameter portion of a fluid pool at 5 MHz, a continuous column of fluid (i.e., a meniscus) can be generated by the acoustic pressure. In the embodiment described above, this column of fluid can then be used (either alone or in combination with other columns of fluid) to saturate a strand element (e.g., a thread). Furthermore, to discontinue the delivery of fluid to the strand element, the acoustic pressure may simply be stopped, which terminates the formation of the column of fluid. The surface tension may then cause the meniscus to retract to the neutral position, thereby interrupting the fluid flow into and/or onto the strand element. However, it is to be understood that other methods of forming each meniscus 20***a*-20*h* may also be utilized in accordance with the disclosure, such as, e.g., applying surface acoustic waves, lasers focused on the liquid surface, magnetic inks, etc.

Figure 3:
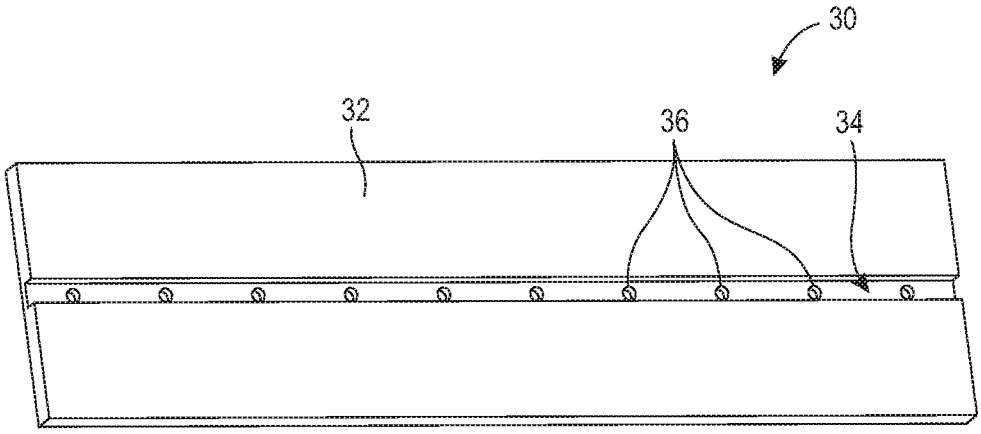
FIG. 3 illustrates a perspective view of a multi-nozzle printing plate in accordance with another aspect of the disclosure.

Next, referring to FIG. 3, a printing plate 30 in accordance with another aspect of the disclosure is shown. Printing plate 30 includes a body 32, a channel 34 formed along a longitudinal length of body 32, and a plurality of nozzles 36 formed through body 32 longitudinally along channel 34. As described above with respect to FIGS. 1-2, a plurality of nozzles may be disposed radially about a conduit so as to allow fluid to be directed toward a strand element from multiple directions. However, with the configuration shown in FIG. 3, not only may multiple nozzles be radially (or otherwise outwardly) disposed around the strand element, but multiple nozzles 36 may also be disposed longitudinally within a channel 34 through which a strand element (not shown) is configured to travel. With this arrangement, fluid can be applied simultaneously along different longitudinal portions of the strand element travelling within channel 34. In some embodiments, the same fluid (e.g., the same color ink) could be utilized within each nozzle 36, thereby speeding the strand element printing process. In other embodiments, different nozzles 36 along the longitudinal length of channel 34 may be configured to emit different fluids (e.g., different colored inks, different) and/or different treatments, allowing the strand element to simultaneously receive different fluids and/or treatments as it passes through the channel 34.

For ease of illustration, only a single printing plate 30 is shown in FIG. 3. However, it is to be understood that multiple printing plates 30 may be combined so as to form a conduit with an enclosed channel to surround the strand element passing through channel 34 and to provide nozzles directed at the strand element from multiple different directions. Furthermore, while printing plate 30 having a plurality of nozzles 36 longitudinally disposed thereon is shown, it is to be understood that a non-plate structure could also include the plurality of longitudinally-spaced nozzles. For example, the cylindrically-shaped conduit 12 described above with respect to FIGS. 1-2 may be configured to include a plurality of longitudinally-spaced nozzles along its length.

Figure 4:
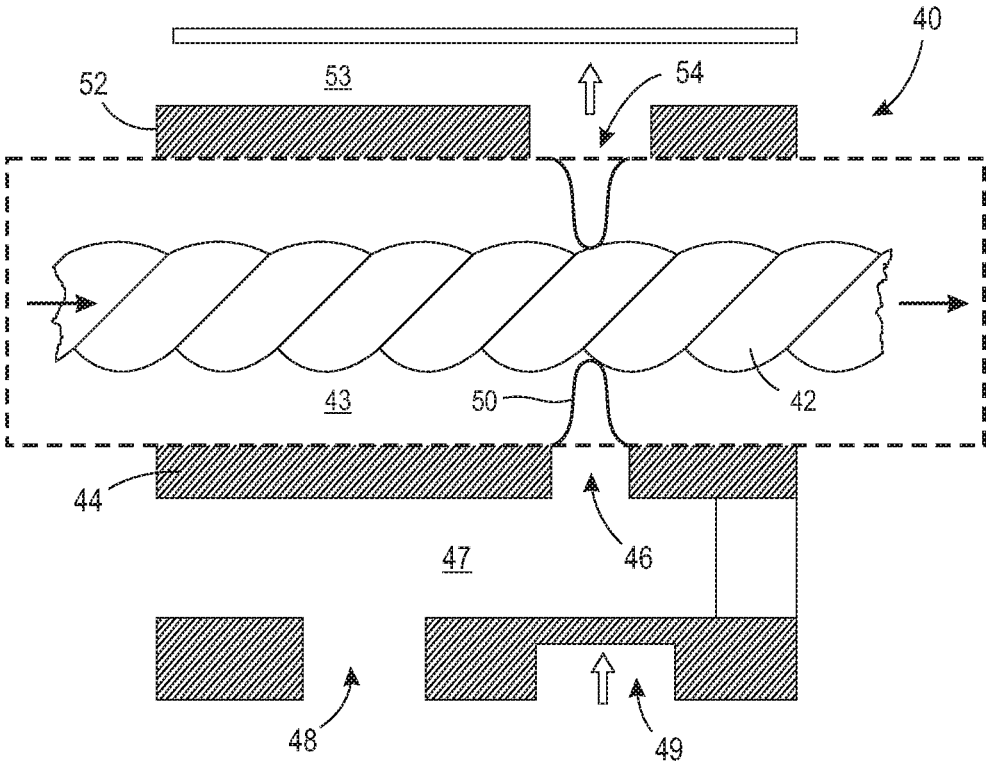
FIG. 4 illustrates a side cross-sectional view of a strand element printer head in accordance with another aspect of the disclosure.

Next, referring to FIG. 4, a printer head 40 in accordance with another aspect of the disclosure is shown. Unlike printer head 10 described above with respect to FIGS. 1-2, printer head 40 is configured to dispense fluid (e.g., ink) toward a strand element (e.g., a thread) by combining the discharge of a fluid meniscus through a nozzle on one side of a strand element and a vacuum sucking action through a nozzle on the opposite side of the strand element. Specifically, the printer head 40 includes a fluid supply body 44 on one side of a cavity 43 and a vacuum supply body 52 on an opposite side of the cavity 43. A strand element 42 is configured to pass through the cavity formed by the combination of the fluid supply body 44 and the vacuum supply body 52, which at least partially surround the strand element 42.

The fluid supply body 44 includes a fluid inlet 48, which may be coupled to one or more external fluid reservoirs (not shown). Fluid delivered through fluid inlet 48 may travel through a channel 47 formed in fluid supply body 44 until it reaches a nozzle 46. Similar to the embodiments described above with respect to FIGS. 1-2, a meniscus 50 (i.e., a column of fluid) may extend from the nozzle 46 into the cavity 43 upon the application of external pressure at a pressure control location 49. The external pressure may be in the form of, e.g., fluidic pressure, magnetic field, ultrasonic acoustic pressure, or any other suitable form of pressure. In this way, the meniscus 50 of fluid may contact a surface of strand element 42 as it passes through the cavity 43 so as to allow a greater volume of fluid to be applied to a surface of the strand element 42 than is possible with conventional inkjet printing methods.

However, in addition to fluid being passed to the strand element 42 by contact with the meniscus 50, in some embodiments, printer head 40 further includes the vacuum supply body 52, which includes a vacuum channel 53 to apply a vacuum force to the cavity 43 through nozzle 54. Thus, not only is fluid applied to the strand element 42 by contact with the meniscus 50, but fluid is drawn by vacuum source to the opposite side of the strand element 42, thereby resulting in uniform distribution of fluid around the strand element 42. In this way, printer head 40 need not necessarily include the jetting of fluid from a plurality of directions surrounding a strand element, but may instead rely at least partially on vacuum force to enable fluid to coat and/or absorb into a strand element.

Figure 5:
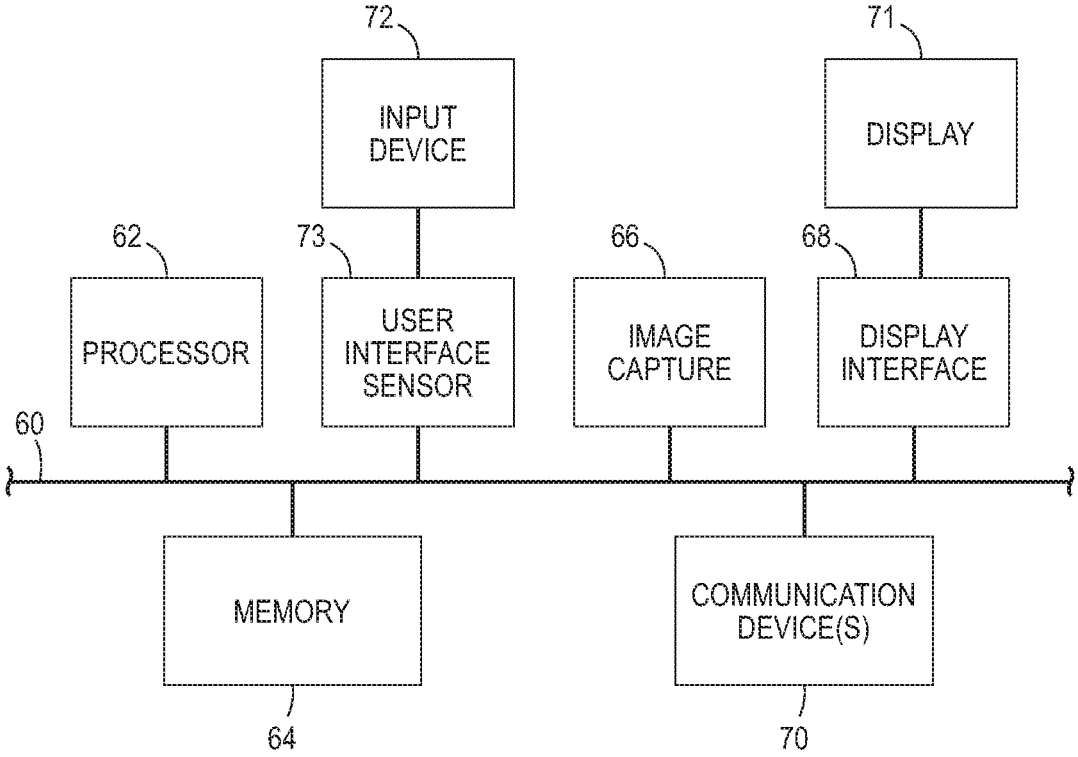
FIG. 5 depicts various embodiments of one or more electronic devices for implementing the various methods and processes described herein.

While not shown in detail, it is to be understood that the printer head 10 of FIGS. 1-2 and/or the printer head 40 of FIG. 4 may be coupled to, and controlled by, any appropriate electronic control system. Accordingly, the pressure and/or vacuum force of the respective printer heads may be controlled such that the fluid meniscus projecting from one or more nozzles may be turned on or off as a strand element passes through the printer head, applying fluid to the strand element at only desired times and for desired durations. FIG. 5 depicts an example of internal hardware that may be included in any of the electronic components of the system, such as a local or remote computing device in the system, or the user's smartphone. An electrical bus 60 serves as an information highway interconnecting the other illustrated components of the hardware. Processor 62 is a central processing device of the system, such as a microprocessor or microcontroller, configured to perform calculations and logic operations required to execute programming instructions.

As used in this document and in the claims, the terms "processor" and "processing device" may refer to a single processor or any number of processors in a set of processors that collectively perform a set of operations, such as a central processing unit (CPU), a graphics processing unit (GPU), a remote server, or a combination of these.

The terms "memory," "memory device," "data store," "data storage facility" and the like each refer to a nontransitory device on which computer-readable data, programming instructions or both are stored. Except where specifically stated otherwise, the terms "memory," "memory device," "data store," "data storage facility" and the like are intended to include single device embodiments, embodiments in which multiple memory devices together or collectively store a set of data or instructions, as well as individual sectors within such devices. Read only memory (ROM), random access memory (RAM), flash memory, hard drives and other devices capable of storing electronic data constitute examples of memory devices 64. A memory device may include a single device or a collection of devices across which data and/or programming instructions are stored.

An optional display interface 68 may permit information from the bus 60 to be displayed on a display device 71 in visual, graphic or alphanumeric format. An audio interface and audio output (such as a speaker) also may be provided. Communication with external devices may occur using various communication devices 70 such as a wireless antenna, an RFID tag and/or short-range or near-field communication transceiver, each of which may optionally communicatively connect with other components of the device via one or more communication system. The communication device 70 may be configured to be communicatively connected to a communications network, such as the Internet, a local area network or a cellular telephone data network.

The hardware may also include a user interface sensor 73 that allows for receipt of data from input devices 72 such as a keyboard, a mouse, a joystick, a touchscreen, a touch pad, a remote control, a pointing device, a video input device and/or an audio input device. Data also may be received from an image capturing device 66, such of that a scanner or camera.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. An apparatus for printing on a strand element, the apparatus comprising:

a printer head, the printer head comprising:

a conduit;

a cavity formed within the conduit, the cavity configured to receive the strand element and pass the strand element from a first end of the cavity to a second end of the cavity;

a first set of fluid nozzles formed on the conduit and positioned on a perimeter of the cavity around a first target location within the cavity, wherein each of the fluid nozzles in the first set is positioned to aim at the first target location, and the first target location corresponds to a location of a first segment of the strand element when the strand element is positioned within the cavity; and a first set of j et heads, wherein:

each of the jet heads is in fluid communication with a respective one of the fluid nozzles, and each of the jet heads is configured to dispense fluid through a respective fluid nozzle in the form of a continuous column of fluid extending radially inward from the respective fluid nozzle.

2. The apparatus of claim 1, wherein the conduit is cylindrical in shape.

3. The apparatus of claim 2, wherein the fluid nozzles of the first set are positioned radially about the cavity.

4. The apparatus of claim 3, wherein each of the jet heads is configured to apply one of fluidic pressure, a magnetic field, and ultrasonic acoustic pressure to form the continuous column of fluid.

5. The apparatus of claim 1, wherein a distance between the first target location and each respective fluid nozzle is 500 μm or less.

6. The apparatus of claim 1, wherein a distance between the first target location and each respective fluid nozzle is 200 μm or less.

7. The apparatus of claim 1, further comprising:

a plurality of additional sets of fluid nozzles positioned along a perimeter of the cavity around a plurality of additional target location within the cavity; and wherein:

each additional target location corresponds to a location of an additional segment of the strand element when the strand element is positioned within the cavity, each of the fluid nozzles in each of the additional sets is positioned to aim at a corresponding one of the additional target location, and each of the additional sets of fluid nozzles is longitudinally spaced along a length of the cavity.

8. The apparatus of claim 7, wherein the conduit comprises a first printing plate and a second printing plate, and wherein:

each of the first printing plate and the second printing plate comprises a strand element channel;

the strand element channels of each of the first printing plate and the second printing plate are aligned to form the cavity; and each set of fluid nozzles comprises a first fluid nozzle that is positioned in the strand element channel of the first printing plate and a second fluid nozzle that is positioned in the strand element channel of the second printing plate.

9. An apparatus for printing on a strand element, the apparatus comprising:

a printer head, the printer head comprising:

a conduit;

a cavity formed within the conduit, the cavity configured to receive the strand element and pass the strand element from a first end of the cavity to a second end of the cavity; and a plurality of nozzles formed on the conduit and positioned on a perimeter of the cavity, wherein each of the nozzles is positioned to aim in a direction of a segment of the strand element passing through the cavity;

wherein each of the nozzles is configured to dispense ink in the form of a continuous column of fluid extending radially inward from a respective nozzle.

10. The apparatus of claim 9, wherein the strand element comprises a thread, and further wherein each of the plurality of nozzles is configured as an ink nozzle.

11. The apparatus of claim 9, wherein at least one of the plurality of nozzles is configured as a fluid nozzle configured to dispense a fluid and at least one other of the plurality of nozzles is configured as a vacuum nozzle to apply a vacuum force on the cavity.

12. The apparatus of claim 11, wherein the fluid nozzle and the vacuum nozzle are positioned opposite one another on the perimeter of the cavity such that the strand element passes between the fluid nozzle and the vacuum nozzle.

13. The apparatus of claim 11, wherein the fluid nozzle is configured to dispense the fluid in the form of a pressure-driven meniscus.

14. A method for printing on a strand element, the method comprising:

providing a printer head, the printer head comprising:

a conduit;

a cavity formed within the conduit; and a plurality of fluid nozzles formed on the conduit and positioned on a perimeter of the cavity around a target location within the cavity, wherein each of the fluid nozzles is positioned to aim at the target location;

passing the strand element through the cavity of the printer head; and dispensing fluid from each of the fluid nozzles in a direction of the strand element within the cavity of the printer head;

wherein the strand element is one of the following: a thread, yarn, filament, wire, optic fiber, microtube for fluid flow, cable, or rope.

15. The method of claim 14, further comprising positioning the plurality of fluid nozzles radially on the perimeter of the cavity.

16. The method of claim 15, further comprising applying one of fluidic pressure, a magnetic field, and ultrasonic acoustic pressure to form a continuous column of fluid extending radially inward from a respective fluid nozzle.

17. The method of claim 14, wherein the fluid from each of the fluid nozzles is dispensed in the form of a continuous column of fluid extending radially inward from a respective fluid nozzle.

18. The method of claim 14, wherein the conduit remains stationary as the strand element passes through the cavity.

* * * * *